US005961065A

United States Patent [19]

Tomma et al.

[11] Patent Number: 5,961,065

[45] **Date of Patent: *Oct. 5, 1999**

[54] METHOD IN WINDING OF A WEB

[75] Inventors: Kauko Tomma, Helsinki; Pauli Koutonen, Jokela; Seppo Saukkonen, Helsinki; Jarmo Malmi, Järvenpää; Arto Leskinen, Nukari; Jari Sinkko, Järvenpää, all of Finland

[73] Assignee: Valmet Corporation, Helsinki, Finland

[ * ] Notice: This patent is subject to a terminal disclaimer.

[21] Appl. No.: 08/982,663

[22] Filed: Dec. 2, 1997

Related U.S. Application Data

[62] Division of application No. 08/591,641, Jan. 24, 1996, Pat. No. 5,732,902.

[30] Foreign Application Priority Data

May 26, 1994 [FI] Finland ..... 942451

[51] Int. Cl.[6] ..... B65H 18/14

[52] U.S. Cl. ..... 242/541.5; 242/530.4

[58] Field of Search ..... 242/541, 541.5, 242/542, 542.2, 547

[56] References Cited

U.S. PATENT DOCUMENTS

| | | | |
|---|---|---|---|
| 1,959,418 | 5/1934 | Fourness . | |
| 3,937,410 | 2/1976 | Justus | 242/541.5 |
| 4,180,216 | 12/1979 | Dahl et al. | 242/541.5 |
| 4,344,585 | 8/1982 | Eglinton . | |
| 4,598,877 | 7/1986 | Oinonen . | |
| 4,601,435 | 7/1986 | Tomma et al. . | |
| 4,746,076 | 5/1988 | Tomma et al. . | |
| 4,749,140 | 6/1988 | Ruff | 242/541.6 |
| 4,811,915 | 3/1989 | Smith | 242/541.6 |
| 5,000,395 | 3/1991 | Welp et al. | 242/547 |
| 5,165,618 | 11/1992 | Ruff . | |
| 5,240,198 | 8/1993 | Dorfel . | |
| 5,275,345 | 1/1994 | Stahl et al. | 242/547 |
| 5,360,180 | 11/1994 | Welp et al. | 242/530.4 |
| 5,518,199 | 5/1996 | Welp et al. | 242/530.4 |
| 5,655,730 | 8/1997 | Beisswanger et al. | 242/542.3 |
| 5,732,902 | 3/1998 | Tomma et al. | 242/541.5 |

FOREIGN PATENT DOCUMENTS

| | | |
|---|---|---|
| 0431476 | 6/1991 | European Pat. Off. . |
| 742833 | 5/1943 | Germany . |
| 2908294 | 11/1980 | Germany . |
| 3128155 | 2/1983 | Germany . |
| 9201791 | 5/1992 | Germany . |
| 9315988 | 8/1993 | WIPO . |

*Primary Examiner*—John P. Darling
*Attorney, Agent, or Firm*—Steinberg & Raskin, P.C.

[57] ABSTRACT

A method for winding a web onto a spool at least partially supported on a support roll in which the web passes through a nip formed between the support roll and a roll formed by the web winding on the spool. The roll being formed is loaded and/or supported by at least one loading/supporting unit which is/are displaced during initial winding stages in a direction substantially in a plane passing through a central axis of the support roll and a central axis of the roll being formed. Thereafter, the loading/supporting unit(s) is/are displaced in a direction substantially along a path parallel to a circumference of the roll being formed, and during final winding stages, the loading/supporting unit(s) is positioned to support the roll being formed from a bottom region thereof.

28 Claims, 11 Drawing Sheets

METHOD IN WINDING OF A WEB

This application is a divisional application of U.S. patent application Ser. No. 08/591,641 filed Jan. 24, 1996, now U.S. Pat. No. 5,732,902.

FIELD OF THE INVENTION

The present invention concerns a method in winding of a web, in which method the web is wound onto a spool on support of a support roll while passed through a nip formed between the support roll and the roll that is being produced, in which method the spool is supported at least partly, in which method the spool/the roll is supported and/or loaded by means of a device whose position can be shifted.

BACKGROUND OF THE INVENTION

When a web, such as a paper or board web, is wound in so-called center-drive winders, it is typical that the rolls that are formed are supported partly from the roll face by circumferential support against the support roll and partly by means of center support by means of seats fitted in the hole in the spool that constitutes the core of the roll. With respect to the prior art related to this, reference is made, for example, to Finnish Patent No. 79,505.

In the prior art solutions, the force of contact of the roll that is being produced against the support roll must often be limited to about 4 kN per meter of roll to about 8 kN per meter of roll width, depending on the paper grade. For example, the weight of a roll of a diameter of 1.5 m may produce a force component of about 20 kN per meter in the direction of the support roll. In such a case, by means of the seats, about 16 kN per meter must be carried. Since, in connection with a large diameter, large roll widths also occur, for example more than 3 m, the support forces at the seats can be even up to 25 kN. In order to avoid spool damage arising from a high seat load, it is necessary to use high-quality special spools of sufficiently large diameters. This again increases the costs of the spools compared with the rolls produced by means of winders of a different type.

As a rule, the prior-art center-drive winder solutions are provided with a drive system acting upon the seats. By means of the torque of the seats, the paper that is wound onto the roll that is being produced is tightened. It is a drawback of this method that the effect of the torque is reduced when the diameter of the paper layer wound onto the circumference of the roll becomes larger. The circumferential force produced with an invariable torque is inversely proportional to the diameter of the roll and is, thus, reduced when the roll becomes larger. Since the strength of the spools limits the torque that can be transferred from the seats, the employment of this method provides just limited help in the control of the roll tightness when large rolls are produced. A further problem of the center drive is the wide range of speeds of rotation that must be controlled by means of the drive gear.

Also, from the prior art, winders are known in which rider roll devices are employed in order that a sufficient pressure could be produced against the support roll in the initial stage of the winding and in order to prevent bending of the spool. During winding of certain paper grades, it has also proved advantageous to employ rider rolls to press the roll throughout the whole winding process.

With respect to the prior art, reference is also made to International patent application PCT/EP93/00140 (WO 93/15988), wherein a device is described for winding a paper or board web, in which device, in view of improving the quality of the lateral rolls, an additional drive gear placed at each side of the winder is used for the lateral rolls, which additional drive gear consists of a roll or belt on which a rotating drive unit of its own is fitted, which unit applies pressure elastically, substantially in the radial direction in relation to the support roll of the winder, against said lateral roll, the axis of rotation of said drive roll or belt being parallel to the axis of the support roll.

With respect to the prior art, reference is also made to FI Patent No. 74,260, in which a solution of a support belt that is fitted in a drum winder is described. From this patent, a winding arrangement is known for winding a moving web, in which arrangement there are support members for supporting the roll that is being formed at least primarily by means of circumferential support and loading members for keeping the roll against the support members, said support members comprising a carrier roll and a mobile support belt member, which supports at least a large roll over a considerable length of the circumference.

OBJECTS AND SUMMARY OF THE INVENTION

It is an object of the invention to provide a method for winding a web during whose application the drawbacks related to the prior art solutions described above are not present. In the solution described in the International Patent Application No. PCT/EP93/00140, there are additional drive gears for the lateral rolls only, and the roll that is being formed cannot be supported by means of the device. The solution described in the FI Patent 74,260 cannot be controlled specifically for each roll, profiling cannot be carried out in it, and spools of different sizes cannot be used in it.

It is an object of the present invention to provide a method by whose means it is possible to wind large rolls, with a diameter even more than 1.5 m and with a width even more than 3 m, free of flaws.

In view of achieving the objectives stated above and those that will come out later, the method in accordance with the invention is mainly characterized in that, in the method, at the initial stages of the winding, the loading/supporting unit/units of this device is/are shifted substantially in the plane passing through the axes of the support roll and of the roll that is being produced so as to load and/or to support the roll that is being produced in the winding position, that, in the method, when the winding makes progress, the loading/supporting unit/units of the device is/are shifted downwards substantially along a path parallel to the circumference of the roll, and that, in the method, at the final stages of the winding, the roll that is being produced is supported by means of this unit from underneath.

The method in accordance with the invention for winding a web permit winding of large rolls free of faults, because the arrangement comprises, for example, loading and supporting functions and surface-drive functions, by whose means it is possible to profile both the nip load, the support, and the surface drive.

The arrangement in accordance with the invention involves highly versatile possibilities of regulation, and it is possible to affect both the geometry of the roll and the structure of the roll. Profiling is possible both in the direction of width and in the direction of the circumference of the roll. In the method in accordance with the invention, both the loading and the surface drive can be regulated freely, for example, specifically for each roll and/or paper grade.

In the method in accordance with the invention, the path of movement of the loading and/or support device is arranged such, during growth of the roll that is being produced, that the force of contact of the device with the roll acts, mainly in the initial stage of the winding, as an additional load and as support of the spool and, in particular in the final stage of the winding, so that it relieves the weight of the roll.

If necessary, the roll that is being formed can be supported by means of the device, for example, with a force up to twice as high as by means of a conventional support roll known from the prior art, without damage being caused to the roll from the contact. When the method of the present invention is applied, the necessary highest force of the center support applied from the seats to the spool can be reduced, even in the cases of heaviest loading, to one third of what it was in the prior art. In this way, in the case of heavy rolls, i.e. of rolls of large size, a particular advantage is obtained as the strain on the spools is reduced along with the reduced support forces et the seats. When the strains on the spool are reduced, the spool damage is reduced, end it is also possible to use more economical solutions in respect of the quality and dimensions of the spools.

By means of the method of the present invention, the problems involved in the center-drive winding in the regulation of the tightness of the roll are avoided, because a freely controllable circumferential force independent from the diameter of the roll is produced, by means of which force the tightness of the roll can be regulated. By means of the improved control of the roll tightness, a possibility is obtained for fault-free winding also with large rolls.

In the following example, the circumferential forces produced with a prior-art arrangement based on center-drive winding and with the device applied in the method of the present invention are compared under similar conditions: web speed 40 meters per second, width of roll produced 2 meters, power of center drive 14 kW (with the maximal speed of rotation), power of rider-roll drive 16 kW (four units in operation), friction coefficient between belts and paper e=0.1 to 0.2, compression Force of the device $f_n$ 2000 N to 4000 N per meter of width.

| | Circumferential force (FU N/m) | |
|---|---|---|
| Roll diameter (d mm) | Prior art | Invention |
| 250 | 175 | 200 |
| 500 | 88 | 200 |
| 1000 | 44 | 200 |
| 1500 | 29 | 200 |

Further, it should be noticed that, in one embodiment of the method of the present invention, the number of the loading/support units that are in operation can be varied, for example, depending on the width of the roll. When the number of units is increased as the roll width becomes larger, the circumferential force calculated per unit of width of the roll remains unchanged in the arrangement in accordance with the present invention. With center drive, on the contrary, the circumferential force produced per unit of width of the roll becomes lower when the width of the rolls produced becomes larger.

Further, by means of the loading arrangement in accordance with the present invention and, along with this arrangement, by means of the possibility of higher loading forces, an improved evacuation of air from between the layers of paper in the roll that is being produced is achieved. This reduces the faults and damage arising in the rolls, in particular when dense and smooth papers are wound, which papers are treated most frequently expressly with center-drive winders.

Moreover, the functions and operations of the method of the present invention are highly versatile and, for example, permit operation of the device as a roll lowering device, holding/stopping of the rolls without a separate device, thus preventing rolling of a roll onto the floor after the seats have been opened for roll exchange.

BRIEF DESCRIPTION OF THE DRAWINGS

In the following, the invention will be described in more detail with reference to the figures in the accompanying drawing, the invention being, however, by no means supposed to be strictly confined to the details in these illustrations.

DETAILED DESCRIPTION OF THE PREFERRED EMBODIMENTS

In the following, the method in accordance with the invention will be described with reference to FIGS. 1A–1E, and further details concerning the method and the device will be described in relation to the other illustrations.

Figures 1A, 1B, 1C:
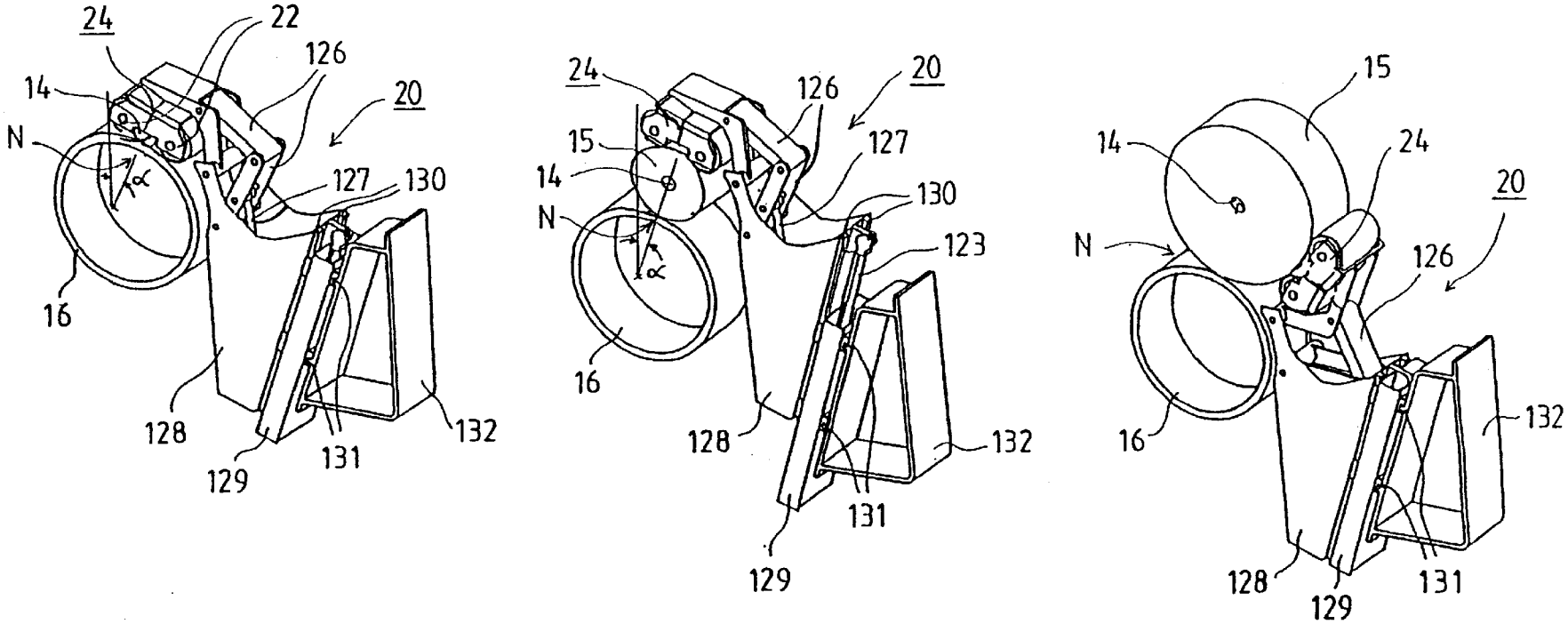
FIGS. 1A, 1B, 1C, 1D and 1E are schematic illustrations in part of some stages of the method of the present invention.

FIG. 1A is a schematic illustration of the starting stage of winding. The web W is passed through the nip N between the support roll 16 and the roll spool 14 to around the spool 14. The rider-roll/support or loading/carrying unit 24 in the device 20 supports the spool 14 in its place in the winding position. The loading/carrying unit 24 has been raised by means of the cylinder 127 and the articulated support arms 126 to the position of start of winding, in which the angle a between the plane passing through the axes of the support roll 16 and the spool 14 and the vertical plane is 0–90°, preferably 10–45°. The spool 14 is placed between the rolls 22 in the unit 24, and the belt (belts) passing around the rolls (22) is (are) most slack. The axes of the spool 14, the support roll 16 and the rolls 22 are substantially parallel.

As is shown in FIG. 1B, when the winding makes progress, the unit 24 of the device 20 moves first along a substantially linear path in the direction of the plane that passes through the substantially parallel axes of the support roll 16 and the roll 15 and supports and loads the roll 15 that is formed around the spool 14 and tightens the web W by means of the surface drive produced by means of the belt. The angle a between the direction of the plane and the vertical direction is 0–90°, for example 20°. By means of the cylinders 123, the sledge construction 128 is displaced along the guides 130 provided on the support sledge 129 as a continuous movement. By means of the loading cylinder 127, the unit 24 is loaded so as to produce the rider roil function, and the belt that passes around the rolls 22 in the unit 24 produces the surface-drive function.

According to FIG. 1C, as the roil 15 grows and the winding makes progress, the unit 24 in the device 20 follows the circumference of the roll 15 that is being completed as a substantially curved movement and supports the roll 15 that is being formed and tightens the web W by means of surface drive. The movement of the unit 24 on the circumference of the roll is produced as a combination of movements produced by means of the articulated support arms 126 and the guides 130. The unit 24 loads/carries the roll 15 that is being completed in the desired proportion, and the tightness of the roll 15 is regulated by means of the surface drive produced by means of the belt.

Figure 1E:
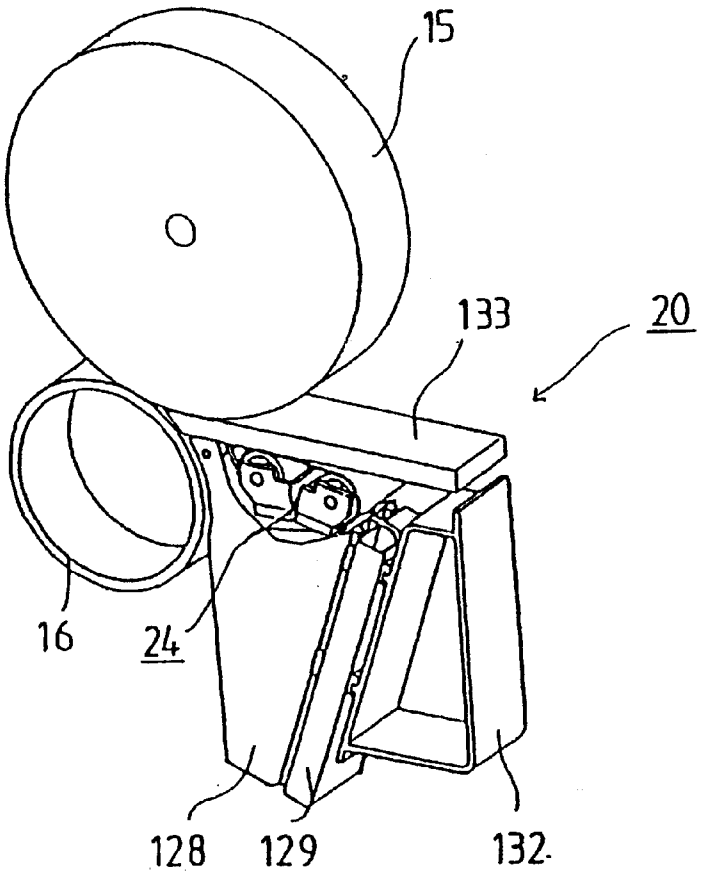
Figure 1D:
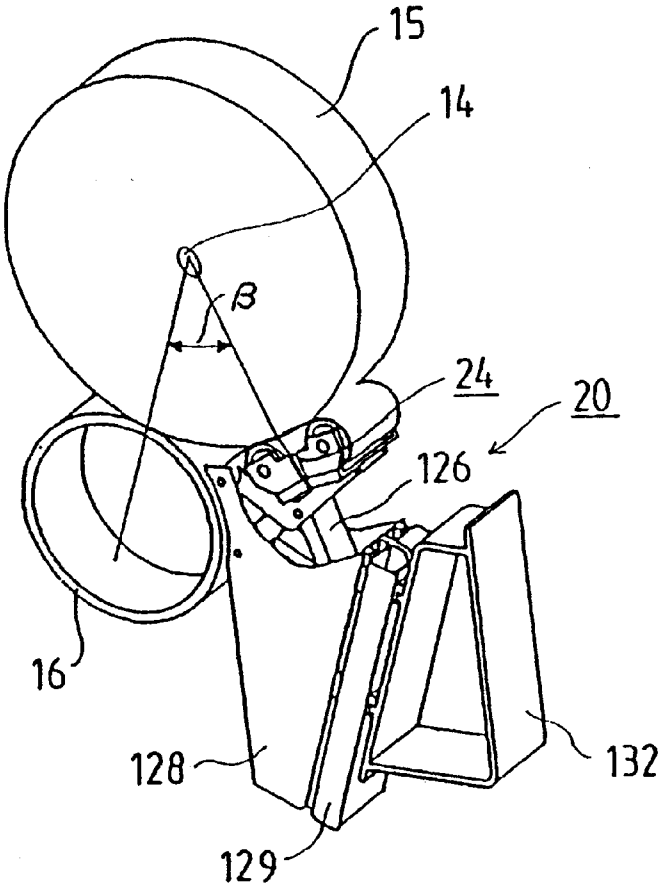

In FIG. 1D, the unit 24 of the device 20 carries and relieves the roll 15 that is being completed from below and acts upon the tightness of the roll 15 that is being produced by means of the surface drive. The unit 24 also operates as a holder of the roll 15 and prevents rolling of the complete roll 15 onto the floor when the center seats have been opened for roll exchange. The angle β between the direction of the plane that passes through the axis of the complete roll 15 and the center axis of the unit 24 and the vertical plane is 0–90°, for example 20°.

In the stage shown in FIG. 1E, the unit 24 of the device 20 has been shifted to the exchange position, in which connection the roll 115 can be transferred to further treatment. For the time of roll exchange, the unit 24 has been shifted into the non-wind position, and the lowering plate 133 guides the complete roll 15 out of the winder. If necessary, instead of the lowering plate 133, the unit 24 may operate as a lowering device.

In the initial stage of winding, in particular when wide rolls 15 are produced, besides the seats that provide the center drive, a geometrical closed surface contact is needed which guides the positioning of the spools 14 and produces the necessary nip load. This is produced by placing the unit 24, at the beginning of the winding, onto the roll 15 to be initiated to contact this roll from the side opposite to the support roll 16. After the roll 15 to be produced has grown to a sufficient extent so that its weight produces a sufficiently high contact force against the support roll 16, the unit 24 is shifted along a substantially curved path to below the roll 15. During the entire winding process, the loading-carrying force applied by the unit 24 to the roll 15 is regulated while the roll grows 15 so that the contact force in the winding nip N between the support roll 16 and the roll 15 remains at the desired level.

Figure 2:
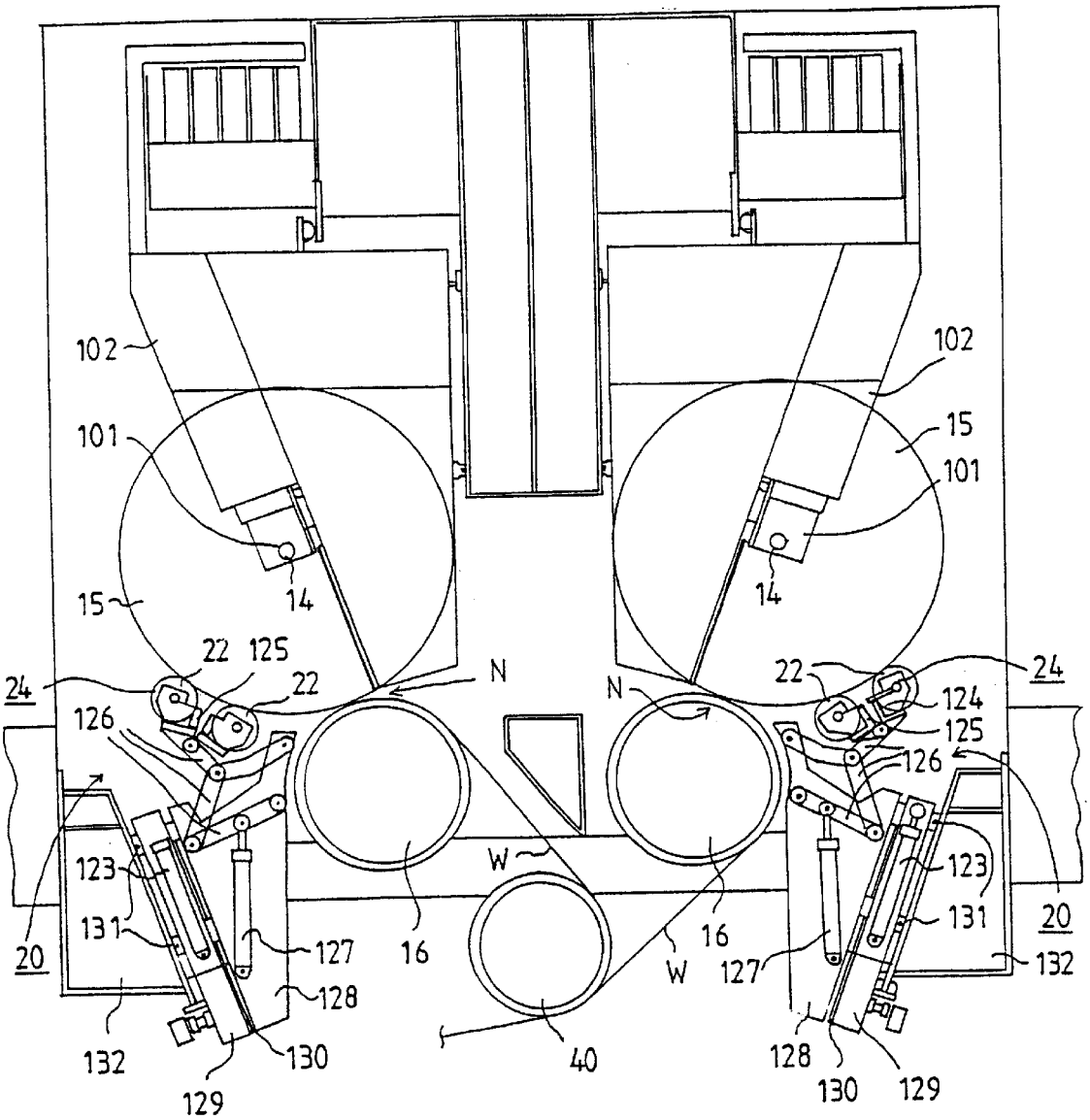
FIG. 2 is a schematic vertical sectional view of an exemplifying embodiment of the invention, for example of that shown in FIG. 3.

FIG. 2 shows an exemplifying embodiment in which the web W is wound by means of a so-called center-drive winder. The web W, such as a paper or board web, is wound by means of a support roll 16 around a spool 14 to make a web roll 15, the web being passed through the nip N between the support roll 16 and the roll 15 that is being produced. Into the hole in the spool 14, seats 101 have been fitted, whose support arms are denoted with the reference numeral 102. This involves center-wind technology in itself known to a person skilled in the art. FIG. 2 shows the winding of the web W onto two rolls 15 by means of two support rolls 16 in a winder (see FIG. 3), and equivalent parts are denoted with the same reference numerals.

FIG. 2 shows, in the final stage of winding, an exemplifying embodiment of the device 20 used in the method of the invention, which device comprises a rider-roll/support unit or a combined loading and/or carrying unit 24. The loading-carrying unit 24 consists of two rolls 22 around which an endless belt/belts 25 is/are fitted running. One or both of the rolls 22 are connected to a drive gear so as to rotate them 22 and the belt 25. Between the rolls 22, a bellows 125 is fitted, by whose means the tension of the belt/belts 25 is regulated. The loading/carrying unit 24 is connected by means of articulated support arms 126 to a loading cylinder 127, by whose means pivoting of the unit 24 along a path parallel to the circumference of the roll 15 is produced. By means of the loading cylinder 127, the desired loading/carrying force for the roll 15 is also produced.

The unit 24 is connected with the sledge construction 128, which moves by means of the cylinder 123 on the support sledge 129 along the linear guide 130, by whose means the movement of the unit 24 in the growth direction of the roll 15 is produced and by means of which movement the basic geometry of the roll is affected. The support sledge 129 of the unit 24 can also be displaced in the direction of width of the roll 15 along guides 131 attached to the stationary support beam 132.

Figure 3:
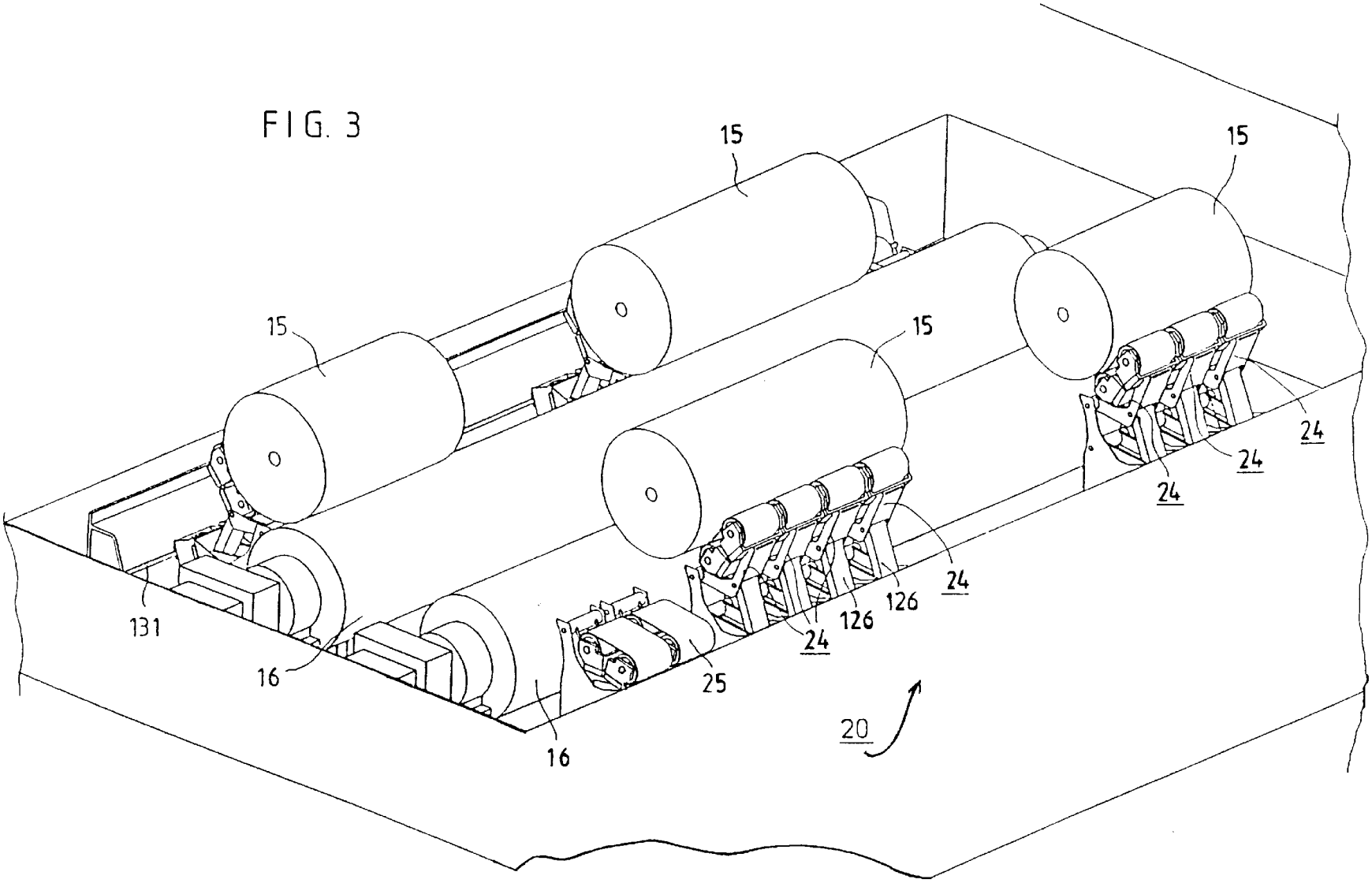
FIG. 3 is a schematic illustration of an exemplifying embodiment of the invention.

As is shown in FIG. 3, the support rolls 16 of the winder are placed side by side, and their axes of rotation are parallel to one another. In FIG. 3, for the sake of clarity of illustration, the constructions related to the center-drive winding arrangement of the rolls 15 have been omitted. In the exemplifying embodiment shown in the figure, the web is wound onto four rolls 15, onto two rolls 15 by means of each of the support rolls 16. The device 20 consists of loading/carrying units 24 placed side by side in the direction of width of the roll 15. The units 24 in the device 20 can be grouped freely so that, in the direction of width of the roll 15, there is the desired number of units 24 placed side by side. As was described in connection with the preceding figure, the units 24 can be displaced in the direction of width of the roll 15 along the guides 131. The units 24 in the device 20 that are placed in the left bottom corner in the figure are shown in the position in which they are placed in a non-winding situation, whereas the other units 24 are shown in the positions occurring towards the end of the winding.

Each unit 24 can be controlled independently, in which case the roll 15 that is produced can be profiled as a function of the support force, i.e. of the carrying force, as a function of the force of gravity, i.e. of the pressure produced by means of the unit 24, and also by means of surface drive and, if desired, also by means of center drive.

Figure 4D:
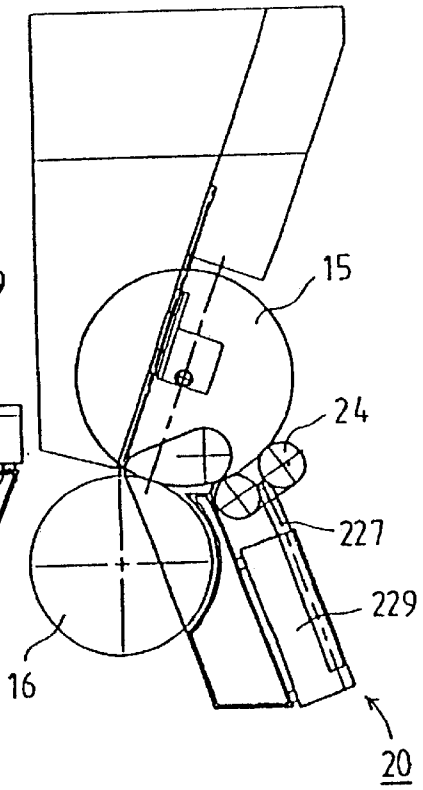
FIGS. 4A, 4B, 4C and 4D are schematic illustrations in part of some stages of the method of the present invention.
Figure 4C:
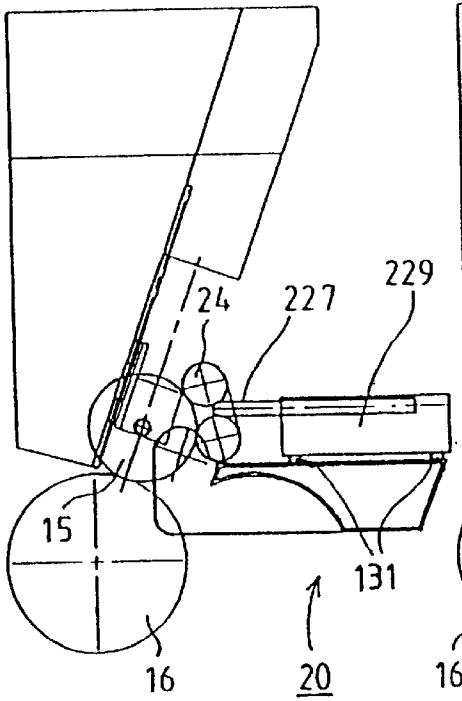
Figure 4B:
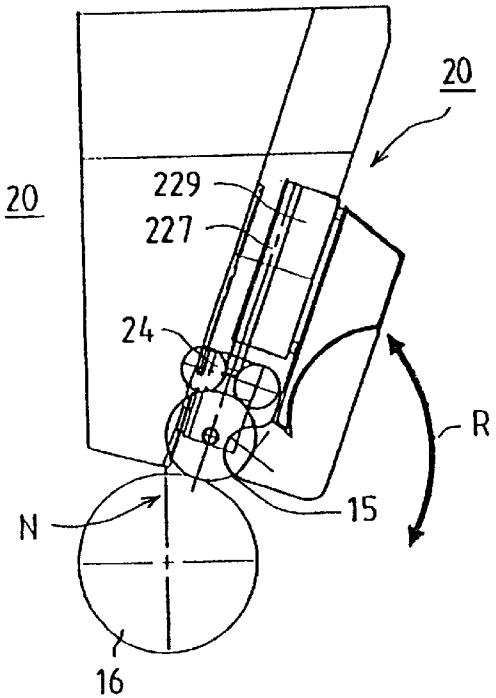
Figure 4A:
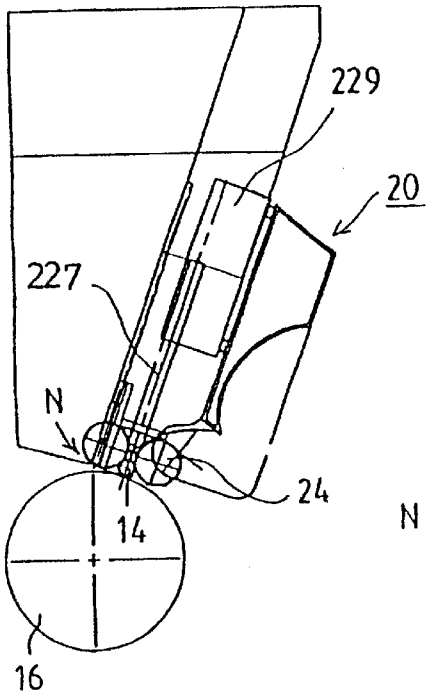

FIG. 4A is a schematic illustration of the initial stage of winding. The web is wound while passed through the nip N between the support roll 16 and the roll spool 14, and the roll is formed around the spool 14. The unit 24 of the device 20 supports the spool 14 in its position in the position of starting of winding, and the spool 14 is loaded against the winding roll 16. The loading is produced by means of the cylinder 227, which is attached to the sledge 229 of the device 20, which sledge is placed in its upper position.

According to FIG. 4B, when the winding makes progress, the unit 24 moves first along a substantially linear path in the direction of the radius of the roll 15 and supports and loads the roll 15 that is being formed around the spool 14 and tightens the web W by means of surface drive. At this stage, the movement of the unit 24 takes place primarily in the plane passing through the centers of the support roll 16 and of the roll 15. When the diameter of the roll 15 becomes larger, the unit 24 moves along a linear path along the guides (not shown) provided on the sledge 229. The loading is carried out in the same way as in connection with FIG. 4A. When the diameter of the roll 15 becomes larger, the device 20, which is provided with articulated joints at its ends, i.e., the so-called rider-roll beam, starts being pivoted downwards in the direction of the arrow R. The pivoting of the device 20 is produced, for example, by means of hydraulic cylinders (not shown) attached to the ends of the beam.

According to FIG. 4C, when the roll 15 grows and the winding makes progress, the device 20 follows the circumference of the roll 15 that is being produced as a substantially curved movement and supports the roll 15 that is being formed and tightens the web W by means of surface drive. The device 20 is pivoted further as a function of the diameter of the roll 15, and the contact with, and the loading against, the roll 15 that is being completed is maintained by means of the unit 24 and by means of the cylinder 227 of the sledge 229.

In FIG. 4D, the device 20 is in its final position while the roll 15 is almost complete. The device 20 supports the roll 15 that is being completed and acts upon the tightness of the roll 15 produced by means of surface drive. When the roll 15 is complete, the device 20 also operates as a holder of the roll and prevents rolling of the roll 15 onto the floor after the seats have been opened for roll exchange. If necessary, the device 20 also operates as a lowering device for the roll 15 in connection with roll exchange. The device 20 has been pivoted to its lower position, and the support/carrying of the roll 15 is carried out by means of the cylinder 227 provided on the rider-roll sledge 229.

The units 24 shown in FIGS. 4A–4D are mounted on the rider-roll beam 229 by means of linear guides and bearings so that the units 24 can be displaced to the desired locations in the direction of width of the machine.

The basic principles of the method steps illustrated in FIGS. 5A–5D and 6A–6D correspond to those illustrated in FIGS. 1A–1E and 4A–4D, and, in the following, particular features of the exemplifying embodiments shown in these figures will be described in more detail.

Figure 5D:
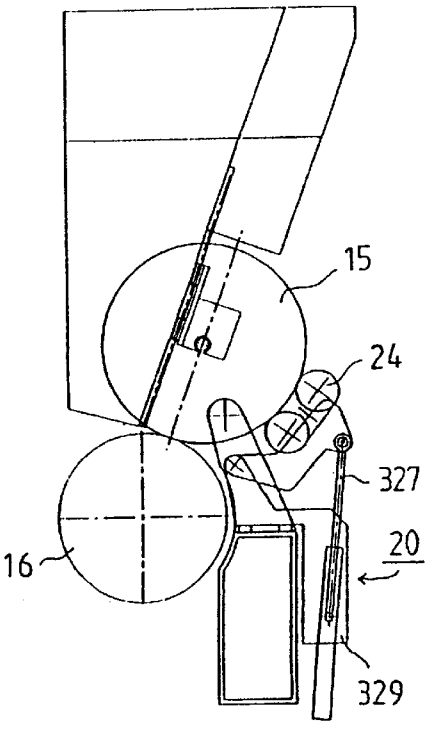
FIGS. 5A, 5B, 5C and 5D are schematic illustrations in part of some stages of the method of the present invention.
Figure 5C:
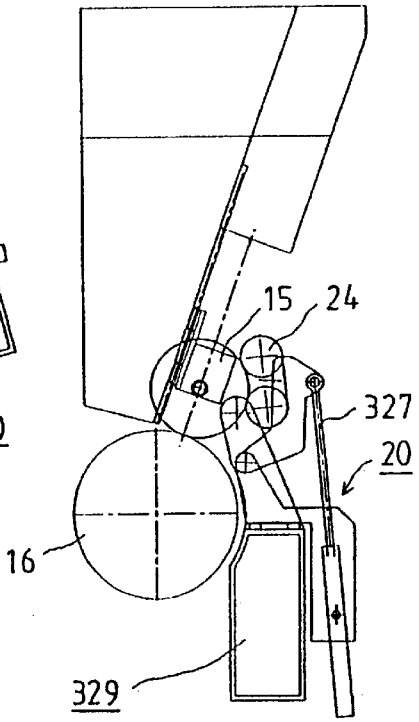
Figure 5B:
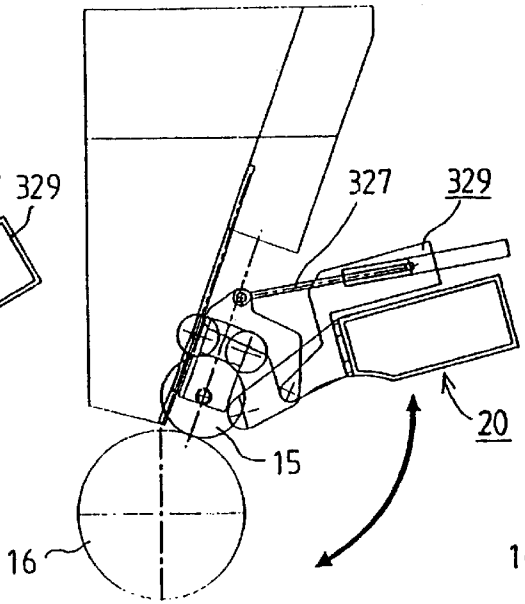
Figure 5A:
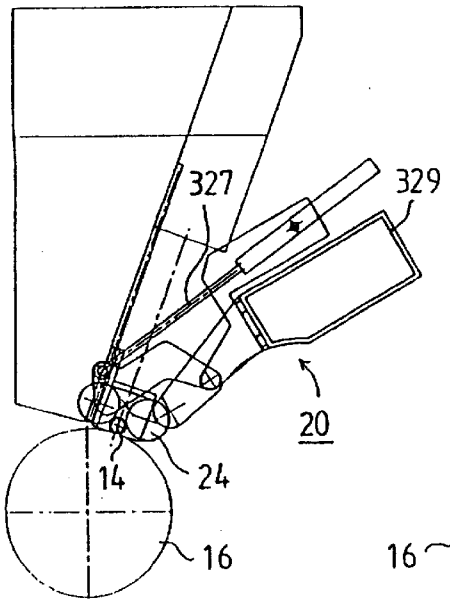

FIG. 5A shows the situation of start of winding, in which the unit 24 loads the spool 14 against the winding roll 16, and the loading is produced by means of the cylinder 327, which is attached to the rider-roll sledge 329. The rider-roll sledge is placed in its upper position.

In the situation shown in FIG. 5B, the diameter of the roll 15 has become larger, and the unit 24 is loaded and displaced by means of the cylinder 327. The initial almost linear loading direction is also produced by pivoting the rider-roll beam 329 as a function of the diameter of the roll 15. The rider-roll beam 329 is provided with articulated joints at its ends, and it is displaced by means of hydraulic cylinders, which are attached to the ends of the beam 329 (not shown).

According to FIG. 5C, when the diameter of the roll 15 grows further, the rider-roll beam 329 is pivoted to its lower position and, at the same time, the unit 24 is controlled by means of the cylinder 327 attached to the sledge 329 so that the contact with the circumference of the roll 15 is maintained all the time, and a certain load S is also maintained between the unit 24 and the roll 15.

In FIG. 5D, the beam 329 is in the lower position, and the support/carrying of the roll 15 is arranged by means of the cylinder 327 provided on the rider-roll sledge 329.

The units 24 shown in FIGS. 5A–5D are mounted by means of linear guides and bearings on the rider-roll beam 329 so that the units 24 can be displaced to the desired locations in the direction of width of the machine (not shown).

Figures 6A, 6B, 6C, 6D:
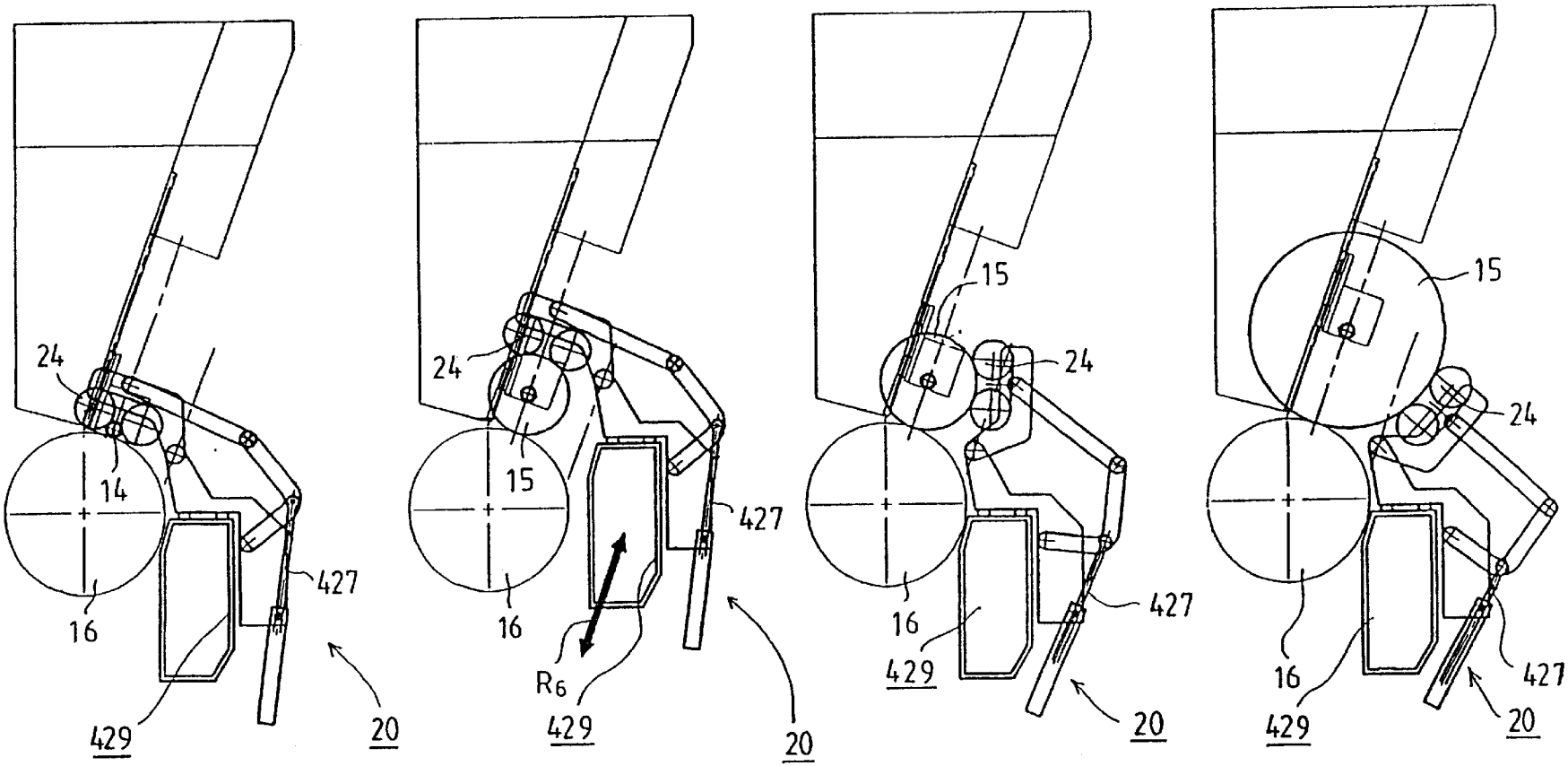
FIGS. 6A, 6B, 6C and 6D are schematic illustrations in part of some stages of the method of the present invention.

In FIG. 6A, in the situation of start of winding, the unit 24, i.e. the set of rider rolls, loads the spool 14 against the winding roll 16, and the loading is produced by means of the cylinder 427. The device 20 is in the lower position.

According to what is shown in FIG. 6B, when the diameter of the roll 15 becomes larger, the rider-roll beam 429 with the units 24 is displaced along a linear path in the direction of the arrow R6 as a function of the diameter of the roll 15. The beam 429 moves on linear guides placed at the ends of the beam, and it is displaced, for example, by means of hydraulic cylinders placed at the ends (not shown). The loading of the roll 15 is arranged in the way described in relation to FIG. 6A.

According to FIG. 6C, when the diameter of the roll 15 grows further, the rider-roll beam 429 and the system formed by its units 24 is guided/displaced so that the unit 24 is constantly in contact with the circumference of the roll 15 that is being completed, being loaded with a certain force against the roll 15. In other words, the beam 429 is displaced back towards its lower position and, at the same time, the lever system 426 and the unit 24 are displaced by means of the loading cylinder.

In FIG. 6D, the rider-roll beam 429 is in the lower position, and the support/carrying of the roll 15 is arranged by means of the lever system 426 and the unit 24 in the final stage of the winding. The support is produced by means of a loading cylinder.

The units 24 shown in FIGS. 6A–6D are mounted on the rider-roll beam 429 by means of linear guides and bearings so that the units 24 can be displaced to the desired locations in the direction of width of the machine (not shown).

Figure 7A:
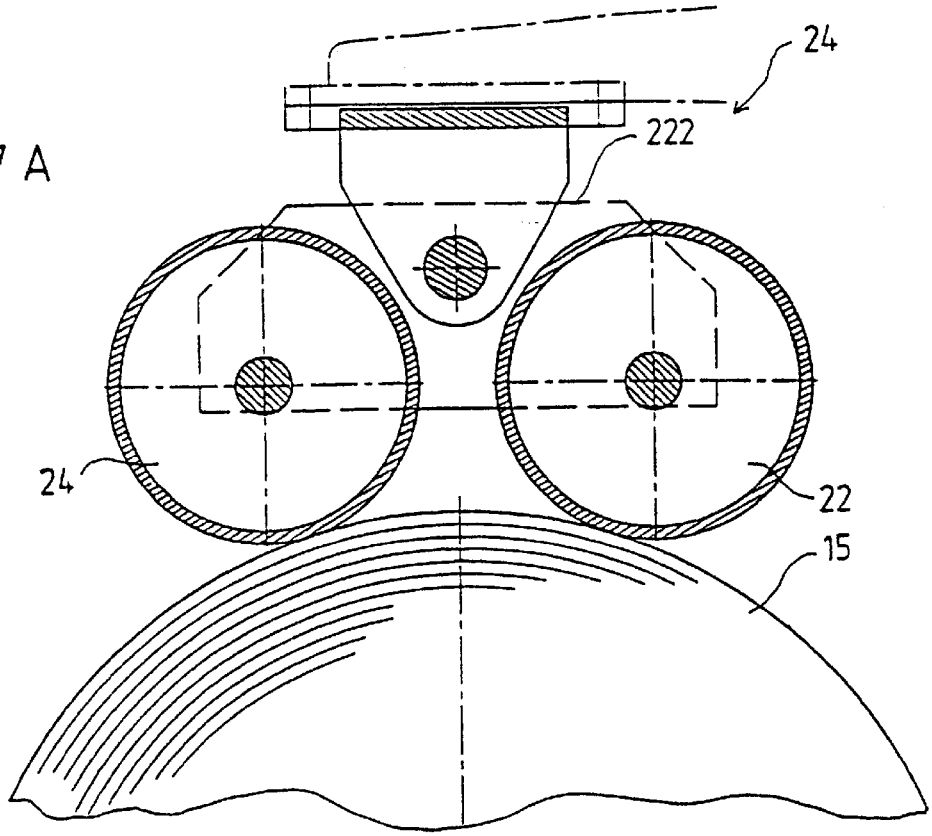
FIGS. 7A, 7B and 7C are schematic illustrations of further exemplifying embodiments of the loading/supporting surface-drive unit of the device.

The exemplifying embodiment of the unit 24 in FIG. 7A comprises two rolls 22.

Figure 7B:
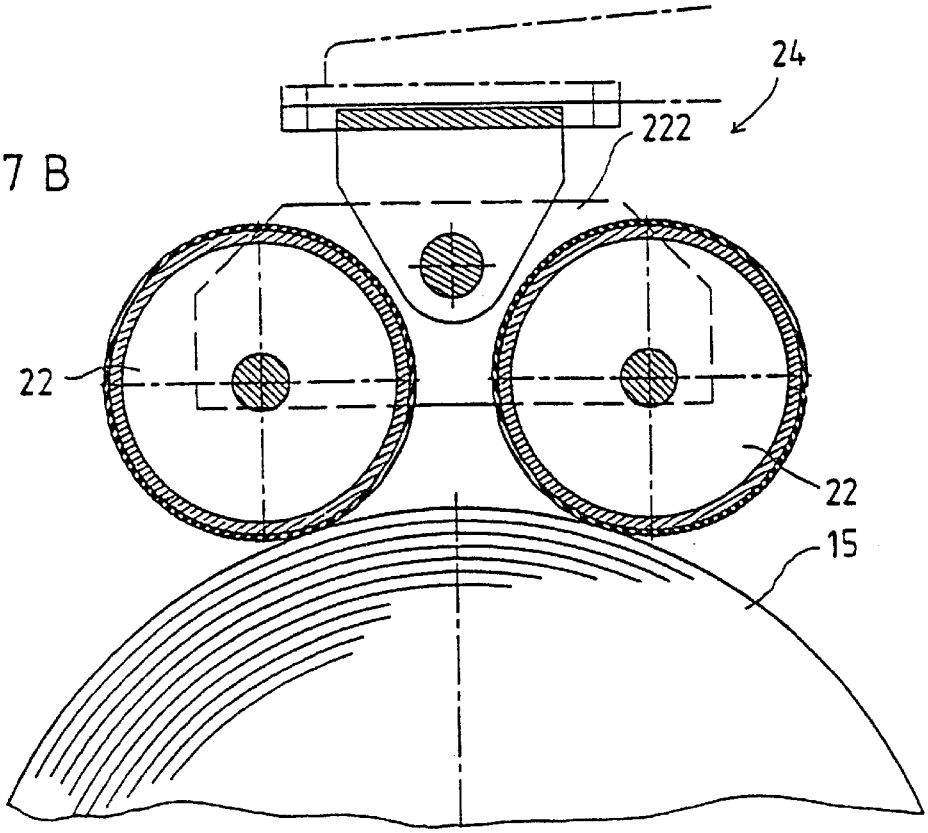

The exemplifying embodiment of the unit 24 shown in FIG. 7B comprises two so-called soft rolls 22 of the sort described, for example, in DE Patent Application 4,035,054 and in DE-GM Publication 9,021, 791.

Figure 7C:
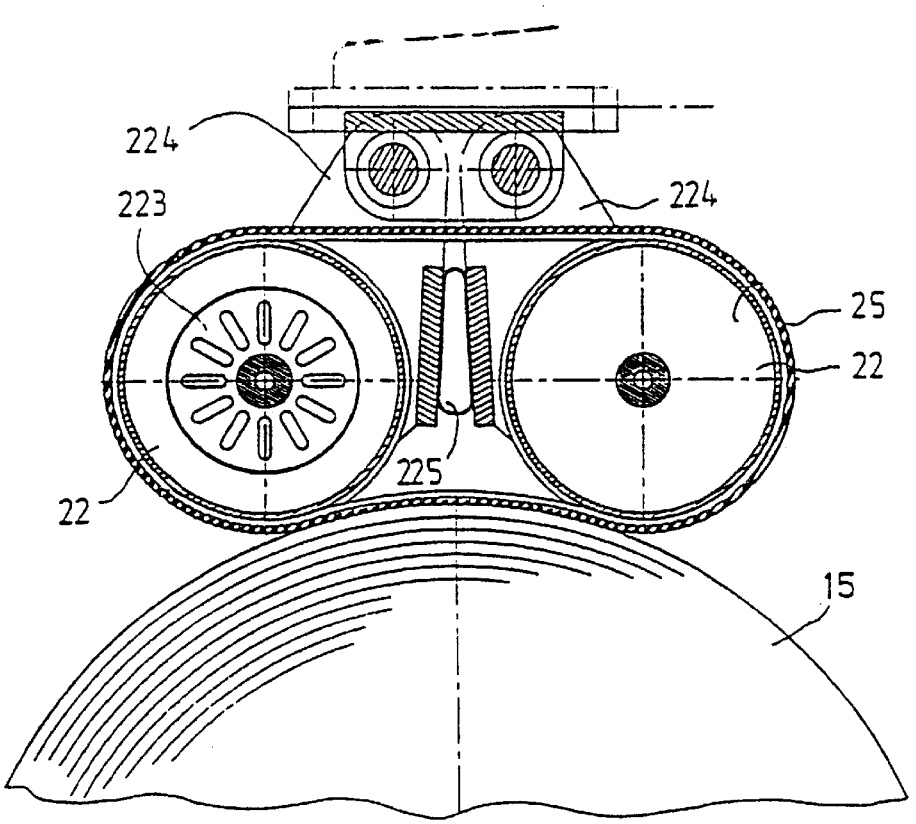

In the exemplifying embodiment shown in FIG. 7C, the unit 24 comprises two rolls 22, one or both of which is/are provided with a drive 223. An endless belt 25 runs around the rolls, and the tension of the belt is regulated, e.g., by means of a bellows arrangement, which consists of a bellows 225 fitted between two articulated support plates 224.

Thus, the unit 24 forms a set of belt rolls, which consists of rolls 22 whose axes are parallel to the axes of the roll 15 that is being formed and the support roll 16, these rolls 22 being surrounded by one or several belts 25 placed side by side in the direction of the axes.

The closed contact geometry needed in the initial stage of winding is provided by means of the support roll 16 and the rolls 22 of the unit 24 by using a belt tension that is low in relation to the load applied by the unit 24 to the roll 15. Then, on the belt 25, at the rolls 22 a higher contact pressure is formed than on the rest of the belt 25, and the positioning of the roll 15 is stable.

After the roll has grown large enough so that the increased rigidity resulting from the larger diameter makes supporting of the spool unnecessary and that the increased weight of the roll makes an additional loading unnecessary, the unit 24 can be shifted so that it supports the roll. At this stage, the diameter of the roll is, as a rule, larger than 0.4 m.

By varying the tension of the belt/belts 25, the desired distribution of pressure is produced in the area of contact between the roll 15 and the belt 25.

Besides by means of the pressure at the winding nip N, the tightness or hardness of the roll 15 can also be controlled highly efficiently by means of the circumferential force applied by the belt/belts 25 to the roll 15.

By means of the contact force of the belt/belts 25, it is possible to transfer a circumferential force to the roll 15, by means of which force it is possible to produce a sliding between the roll 15 and the incoming paper web in the area of the winding nip N, i.e., of the contact point between the support roll 16 and the paper roll 15. Then, if desired, it is possible to tighten/slacken the paper that is being wound on the surface of the roll 15 and to control the tightness or hardness of the roll 15 that is being produced by means of the drive power of the belt/belts 25.

By means of appropriately chosen surface materials of the belts 25, such as rubber, it is possible to produce a friction force in the contact between the paper and the belt 25 which force is higher than the friction force between the layers of paper. Thus, by means of the belt 25, it is possible to tighten the roll 15 as the circumferential force produced by the belt is higher than the friction force between the paper layers.

By means of appropriately tensioned belts 25, when the contact pressure is distributed evenly over the entire contact area between the belt 25 and the roll 15, the roll 15 can be supported in practice with a force higher than 10 kN per meter of width of the roll 15.

The device 20 and its unit can be provided with various alternative drive systems that are in themselves known to a person skilled in the art, such as any of the following types:

1. The units 24 placed at the same time of the winder receive their drive from a common main shaft by means of a belt drive system.

2. The unit 24 placed on each roll 15 that is produced is provided with one or several drive motors. The motors or motor placed on one roll 15 form(s) one drive group. The power that is supplied to each drive group can be controlled separately, independently from the others.

3. In each unit 24, one roll or both rolls is/are provided with a motor. The drives of the rolls can be connected electrically as units specific for each paper roll. The possibilities of regulation are similar to those in the alternative 2, and further, profiling can be carried out in the direction of width of the roll by means of a separate regulation of the drive specific for each unit. The choice of the drive system is affected in each particular case by the requirements of quality standard and by the expenses. Separate roll-specific drive groups permit regulation of the roll tightness independently from other rolls.

Figure 8C:
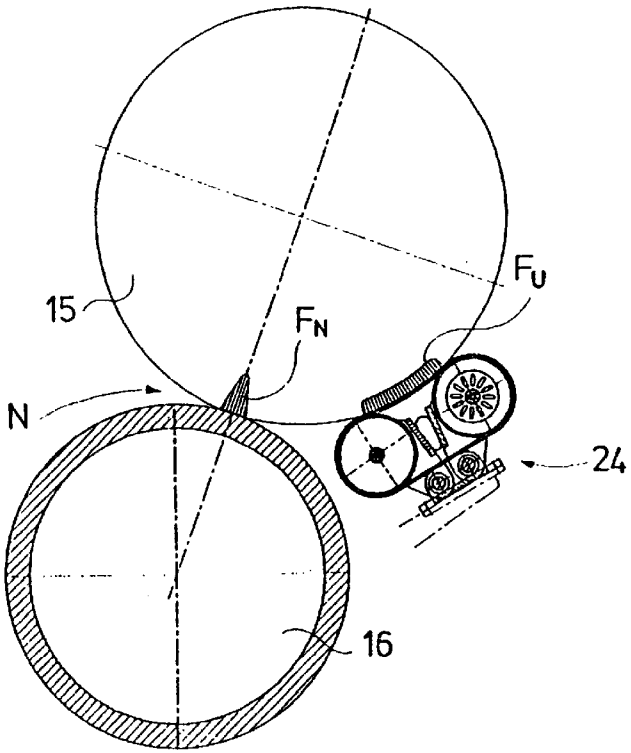
FIGS. 8A, 8B and 8C are schematic illustrations of the distribution of the pressure of winding in the different stages of winding in the method of the present invention.
Figure 8B:
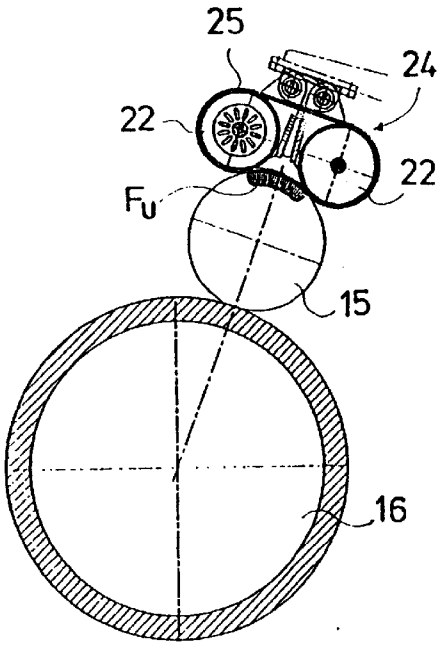
Figure 8A:
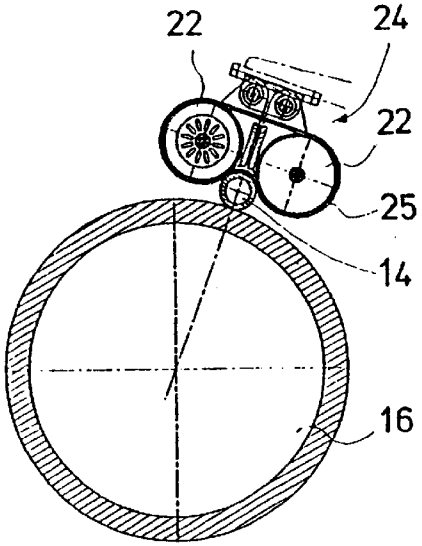

As is shown in FIGS. 8A–8C, a belt/belts 25 has/have been fitted to surround two rolls 22 in the direction of the roll 22 axis. When the unit 24 is pressed against the paper roll 15, the contact force FU is transferred to the roll 15 face by the intermediate of the belt/belts 25. When the belts 25 are tensioned appropriately, the desired distribution of contact pressure is obtained between the unit 24 and the roll 15. By means of the unit 24, the paper roll 15 can be pressed with a force of the desired magnitude without producing damage to the roll 15.

The pressing mentioned above is necessary when a circumferential force is transferred to the face of the roll that is being produced 15, which force is, unlike the force produced by means of a center-drive winder, independent from the diameter of the roll 15. Even with large roll 15 diameters, the winding tightness can be controlled by means of the circumferential force.

In the initial situation of winding shown in FIG. 8A, the belt 25 that runs around the rolls 22 is slack, so that it supports the spool 14 in its position against the support roll 16.

In the winding stage as shown in FIG. 8B, the unit 24 loads the paper roll 15 that is being formed. The belt 25 that runs around the rolls 22 in the unit 24 has been tensioned to produce the desired distribution of contact force FU.

FIG. 8C shows the situation at the final stage of winding, in which the paper roll 15 that is being formed is loaded and supported by means of the unit 24. By means of the tension of the belt 25 that runs around the rolls 22, the desired distribution of contact force FU has been regulated, and the distribution of forces effective in the nip N between the support roll 16 and the paper roll 15 that is formed is denoted with the reference FN.

Figure 9:
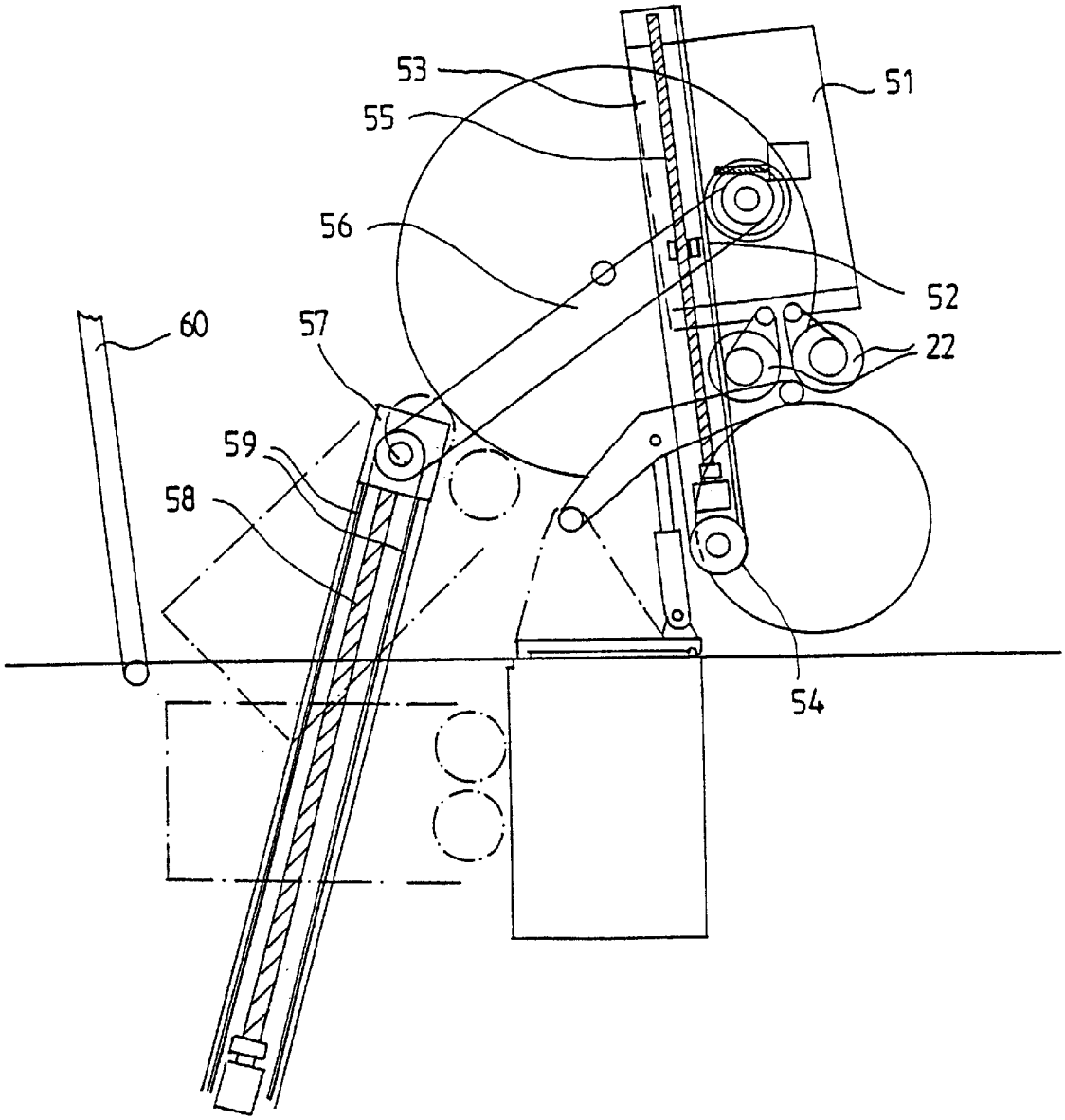
FIG. 9 shows an application of the method in accordance with the invention in a prior-art device.

According to an exemplifying embodiment fitted in connection with a prior-art device, illustrated in FIG. 9, the beam 51, which carries the units 24 and which extends across the carrying width, is attached by its ends to support arms by means of bearings 52 that permit rotating of the beam. The support arms 53 pivot on the frame of the machine around a fixed articulation point 54. The support arms 53 form guides, along which the bearing housings 52 are displaced by means of shifting screws 55. The shifting screws are provided with drive gears and measurement detectors. At the journalling point, the beam 51 is coupled at one of its ends, from its shaft, with a bearing housing 52 by means of a mechanism consisting of a spiral gear and a screw. By means of the mechanism, the position of the beam 51 is rotated in relation to the bearing housing 52 and to the guide 53 that guides it. By means of the measurement detector connected with the mechanism, the angle over which the beam 51 has revolved in relation to the guide is detected. On the shafts of the beam 51, lifting arms 56 are also mounted as freely pivoting. The opposite ends of the lifting arms 56 are mounted similarly on sledges 57, which are displaced by means of shifting screws 58 along guides 59 attached to the frame of the machine. The detectors connected with the shifting screws indicate the position of the sledges 57 on the guide 59. By means of a program of the processor that controls the movements of the set of rolls 24, it is possible to choose the direction of loading of the rolls 22 with different roll 15 diameters so that the direction is optimal in each particular case. The same program can be connected suitably with controls of the loading force of the rolls 22, the tensioning of the belts 25, the circumferential force to be used, and the force of relieving the seats. Upon completion of the rolls 15, the roll beam 51 is lowered to its lowest position, and the covering gate 60, which operated as a shield during winding, is lowered onto the roll equipment to the floor position. Upon removal of the rolls 15 and upon fitting of new spools, the gate is raised to its upper position. The roll equipment is shifted to load the spools, and the winding of new rolls is started. The necessary control of the movement of the roll 15 equipment can be arranged, for example, by means of slide constructions illustrated in the figures. The path of movement of the roll equipment is controlled by means of a processor into positions that are determined by the roll diameter or by the working step to be carried out. Constant identification of the positions and locations of the rolls takes place by means of detectors coupled in connection with each movement mechanism.

Above, the invention has been described with reference to some preferred exemplifying embodiments of same only, the invention being, however, by no means supposed to be strictly confined to the details of these embodiments, and many variations and modifications are possible within the scope of the inventive idea defined in the following patent claims.

We claim:

1. In a method for winding a web onto a spool to form a roll about the spool, wherein the spool is at least partially supported on a support roll, the web is initially wound onto the spool by passing it through a nip formed between the support roll and the spool and then the web is wound onto the roll being formed by passing it through a nip formed between the support roll and the roll being formed, the improvement comprising the steps of:

loading and/or supporting the roll being formed by means of a plurality of loading/supporting units arranged in a direction of width of the roll being formed and operating against the roll being formed, and independently regulating at least one of the loading of the roll provided by the loading/supporting units, the support of the roll provided by the loading/supporting units and the speed of a roll-contacting surface of the loading/supporting units during the winding of the web to thereby profile the roll being formed in the direction of width thereof.

2. The method of claim 1, wherein the loading and/or support of the roll being formed provided by the loading/supporting unit is regulated by generating a contact force between the loading/supporting units and the roll being formed oriented in a direction of a radius of the roll being formed and/or in the direction of width of the roll being formed.

3. The method of claim 1, further comprising the steps of:

arranging a surface drive member in connection with the loading/supporting units and in engagement with the roll being formed, and regulating the tightness of the roll being formed by means of the surface drive member.

4. The method of claim 1, further comprising the steps of:

during initial winding stages, displacing the loading/supporting units in a direction substantially in a plane passing through a central axis of the support roll and a central axis of the roll being formed, thereafter, displacing the loading/supporting units in a direction substantially along a path parallel to a circumference of the roll being formed, and during final winding stages, positioning the loading/supporting units to support the roll being formed from a bottom region thereof in order to relieve weight of the roll being formed on the support roll.

5. The method of claim 1, further comprising the steps of:

arranging a surface drive member in connection with the loading/supporting units and in engagement with the roll being formed, and profiling the roll being formed by regulating the surface drive provided by the surface drive member.

6. The method of claim 1, further comprising the steps of:

providing at least one of the loading/supporting units with a pair of rolls, passing an endless belt over the pair of rolls and in engagement with the roll being formed, and regulating the distribution of contact pressure between the loading/supporting units and the roll being formed by regulating tension of the belt.

7. The method of claim 6, wherein the tension of the belt is regulated by arranging a variable bellows between the pair of rolls.

8. The method of claim 1, further comprising the steps of:

releasably supporting the spool and thus the roll being formed at axial ends thereof, releasing the axial support of the spool and roll being formed upon completion of the roll being formed, and then controlling the position of the roll substantially only by means of the loading/supporting units.

9. The method of claim 1, further comprising the step of:

upon completion of the roll being formed, lowering the completed roll from a winding station in which the roll being formed is in nip-engagement with the support roll by means of the loading/supporting units.

10. The method of claim 1, wherein said loading/supporting units are arranged alongside one another across substantially the entire length of the roll being formed including in a middle region along the length of the roll.

11. The method of claim 1, where in the speed of a roll-contacting surface of the loading/supporting unit is independently regulated, further comprising the steps of:

providing each of the loading/supporting units with a pair of rolls, passing an endless belt over each pair of rolls and in engagement with the roll being formed, the endless belt constituting the roll-contacting surface of each loading/supporting unit, and independently regulating the speed of each belt such that the roll being formed is profiled in a direction of width thereof.

12. The method of claim 1, further comprising the steps of:

providing the loading/supporting units with a pair of rolls, said rolls being spaced along the circumference of the roll being formed, and independently regulating the speed of each of said rolls such that the roll being formed is profiled in a direction of circumference thereof.

13. In a method for winding a web onto a spool at least partially supported on a support roll to form a roll about the spool, wherein the web is initially wound onto a spool by passing it through a nip formed between the support roll and the spool and then the web is wound onto the roll being formed by passing it through a nip formed between the support roll and the roll being formed, the improvement comprising the steps of:

loading and/or supporting the roll being formed by means of a plurality of loading/supporting units, arranging at least one belt in each of the loading/supporting units in engagement with the roll being formed, and independently regulating the speed of the belt of the loading/supporting units during the winding of the web to thereby profile the structure of the roll being formed in the direction of width thereof.

14. The method of claim 13, further comprising the step of:

regulating the loading and/or support of the roll being formed by means of a contact force produced by the loading/supporting units in a direction of a radius of the roll being formed and/or in the direction of width of the roll being formed.

15. The method of claim 13, further comprising the step of:

regulating the tightness of the roll being formed by regulating the speed of the belt.

16. The method of claim 13, further comprising the steps of:

during initial winding stages, displacing the loading/supporting units in a direction substantially in a plane passing through a central axis of the support roll and a central axis of the roll being formed, thereafter, displacing the loading/supporting units in a direction substantially along a path parallel to a circumference of the roll being formed, and during final winding stages, positioning the loading/supporting units to support the roll being formed from a bottom region thereof in order to relieve weight of the roll being formed on the support roll.

17. The method of claim 13, further comprising the steps of:

providing at least one of the loading/supporting units with a pair of rolls, passing an endless belt over the pair of rolls and in engagement with the roll being formed, and regulating the distribution of contact pressure between the loading/supporting units and the roll being formed by regulating tension of the belt.

18. The method of claim 13, further comprising the steps of:

releasably supporting the spool and thus the roll being formed at axial ends thereof, releasing the axial support of the spool and roll being formed upon completion of the roll being formed, and then controlling the position of the roll substantially only by means of the loading/supporting units.

19. The method of claim 13, further comprising the step of:

upon completion of the roll being formed, lowering the completed roll from a winding station in which the roll being formed is in nip-engagement with the support roll by means of the loading/supporting units.

20. The method of claim 13, further comprising the step of:

profiling the structure of the roll being formed by regulating the loading and/or support of the roll being formed provided by said loading/supporting units during the winding of the web.

21. The method of claim 13, wherein said loading/supporting units are arranged alongside one another across substantially the entire length of the roll being formed including in a middle region along the length of the roll.

22. In a method for winding a web onto a spool at least partially supported on a support roll to form a roll about the spool, wherein the web is initially wound onto a spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, arranging at least one belt in the at least one loading/supporting unit in engagement with the roll being formed, profiling the structure of the roll being formed by regulating the speed of the belt, and upon completion of the roll being formed, lowering the completed roll from a winding station in which the roll being formed is in nip-engagement with the support roll by means of the at least one loading/supporting unit.

23. In a method for winding a web onto a spool to form a roll about the spool, wherein the spool is at least partially supported on a support roll, the web is initially wound onto the spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, profiling the roll being formed by regulating the loading and/or support of the roll provided by the at least one loading/supporting unit during the winding of the web, during initial winding stages, displacing the at least one loading/supporting unit in a direction substantially in a plane passing through a central axis of the support roll and a central axis of the roll being formed, thereafter, displacing the at least one loading/supporting unit in a direction substantially along a path parallel to a circumference of the roll being formed, and during final winding stages, positioning the at least one loading/supporting unit to support the roll being formed from a bottom region thereof in order to relieve weight of the roll being formed on the support roll.

24. In a method for winding a web onto a spool to form a roll about the spool, wherein the spool is at least partially supported on a support roll, the web is initially wound onto the spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, profiling the roll being formed by regulating the loading and/or support of the roll provided by the at least one loading/supporting unit during the winding of the web, providing the at least one loading/supporting unit with a pair of rolls, passing an endless belt over the pair of rolls and in engagement with the roll being formed, and regulating tension of the belt by arranging a variable bellows between the pair of rolls to thereby regulate the distribution of contact pressure between the at least one loading/supporting unit and the roll being formed.

25. In a method for winding a web onto a spool to form a roll about the spool, wherein the spool is at least partially supported on a support roll, the web is initially wound onto the spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, profiling the roll being formed by regulating the loading and/or support of the roll provided by the at least one loading/supporting unit during the winding of the web, releasably supporting the spool and thus the roll being formed at axial ends thereof, releasing the axial support of the spool and roll being formed upon completion of the roll being formed, and then controlling the position of the roll substantially only by means of the at least one loading/supporting unit.

26. In a method for winding a web onto a spool to form a roll about the spool, wherein the spool is at least partially supported on a support roll, the web is initially wound onto the spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, profiling the roll being formed by regulating the loading and/or support of the roll provided by the at least one loading/supporting unit during the winding of the web, and upon completion of the roll being formed, lowering the completed roll from a winding station in which the roll being formed is in nip-engagement with the support roll by means of the at least one loading/supporting unit.

27. In a method for winding a web onto a spool at least partially supported on a support roll to form a roll about the spool, wherein the web is initially wound onto a spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, arranging at least one belt in the at least one loading/supporting unit in engagement with the roll being formed, profiling the structure of the roll being formed by regulating the speed of the belt, during initial winding stages, displacing the at least one loading/supporting unit in a direction substantially in a plane passing through a central axis of the support roll and a central axis of the roll being formed, thereafter, displacing the at least one loading/supporting unit in a direction substantially along a path parallel to a circumference of the roll being formed, and during final winding stages, positioning the at least one loading/supporting unit to support the roll being formed from a bottom region thereof in order to relieve weight of the roll being formed on the support roll.

28. In a method for winding a web onto a spool at least partially supported on a support roll to form a roll about the spool, wherein the web is initially wound onto a spool by passing it through a nip formed between the support roll and the spool and then the web is wound onto the roll being formed by passing it through a nip formed between the support roll and the roll being formed, the improvement comprising the steps of:

loading and/or supporting the roll being formed by means of at least one loading/supporting unit, arranging at least one belt in the at least one loading/supporting unit in engagement with the roll being formed, profiling the structure of the roll being formed by regulating the speed of the belt, releasably supporting the spool and thus the roll being formed at axial ends thereof, releasing the axial support of the spool and roll being formed upon completion of the roll being formed, and then controlling the position of the roll substantially only by means of the at least one loading/supporting unit.

* * * * *